US006318467B1

(12) United States Patent
Liu et al.

(10) Patent No.: US 6,318,467 B1
(45) Date of Patent: Nov. 20, 2001

(54) SYSTEM AND METHOD FOR PUMPING AND HEATING VISCOUS FLUIDS IN A WELLBORE

(75) Inventors: Joseph C. Liu, Tulsa; Rick Bailey, Bartlesville, both of OK (US)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/452,669

(22) Filed: Dec. 1, 1999

(51) Int. Cl.[7] ..... E21B 36/04; E21B 43/24

(52) U.S. Cl. ..... 166/302; 166/60; 166/62

(58) Field of Search ..... 166/60, 65.1, 105, 166/302, 369, 62

(56) References Cited

U.S. PATENT DOCUMENTS

| | | | |
|---|---|---|---|
| 2,429,940 | 10/1947 | McDaniel | 103/234 |
| 2,556,435 | 6/1951 | Moehrl et al. | 103/87 |
| 2,601,533 | 6/1952 | Koch | 183/32 |
| 2,615,114 | 10/1952 | Colby . | |
| 2,632,836 | 3/1953 | Ackley | 219/33 |
| 2,703,621 | 3/1955 | Ford | 166/60 |
| 2,738,409 | 3/1956 | Bowman | 219/33 |
| 2,742,967 | 4/1956 | Carpenter . | |
| 2,951,165 | 8/1960 | Arutunoff | 310/54 |
| 2,980,184 | 4/1961 | Reed | 166/57 |
| 3,045,099 | 7/1962 | Bowman et al. | 219/33 |
| 3,130,287 | 4/1964 | Toulmin, Jr. | 219/39 |
| 3,187,814 | 6/1965 | McCarthy | 166/60 |
| 3,286,771 | 11/1966 | Sisson | 166/177 |
| 4,685,867 | 8/1987 | Patun et al. | 417/367 |
| 5,620,048 | 4/1997 | Beauquin | 166/62 |
| 5,782,301 * | 7/1998 | Neuroth et al. | 166/302 |
| 5,974,226 * | 10/1999 | Shafer | 392/301 |
| 6,006,837 * | 12/1999 | Breit | 166/302 |
| 6,009,940 * | 1/2000 | Eck et al. | 166/60 |

* cited by examiner

*Primary Examiner*—David Bagnell
*Assistant Examiner*—Jennifer R. Dougherty
(74) *Attorney, Agent, or Firm*—Fletcher, Yoder & Van Someren

(57) ABSTRACT

A system for pumping and heating viscous fluids in a wellbore includes electrical power supplies, a switchboard, conductors, and a submergible pumping system having a pump and a submergible electric motor. The electrical power supplies are coupled to the submergible pumping system through a switchboard and conductors that supply electrical power to the motor. The electrical power supplies provide direct or alternating current and include protective circuitry. The submergible pumping system may be supplied with electrical power to motor stator windings to generate heat to raise the temperature and lower the viscosity of adjacent viscous fluids.

21 Claims, 4 Drawing Sheets

SYSTEM AND METHOD FOR PUMPING AND HEATING VISCOUS FLUIDS IN A WELLBORE

FIELD OF THE INVENTION

The present invention relates generally to a system and method for pumping and heating viscous fluids to be produced from petroleum production wells and the like. More particularly, the invention relates to a system and method for heating fluids in the vicinity of a submergible pumping system of the type employed to produce fluids from petroleum wells.

BACKGROUND OF THE INVENTION

In the field of petroleum production, various techniques may be employed for raising viscous fluids, such as crude oil to the earth's surface from a wellbore. In a typical well, perforations are formed in the casing of a wellbore through which production fluids, such as crude oil, may penetrate and collect in the wellbore. Where ambient pressures are insufficient to force the fluid to the earth's surface for processing, submergible pumps are typically employed to pump production fluids up through the wellbore to collection points. Such wells and pumping arrangements may be located both on dry land and beneath bodies of water, such as over continental shelves, lakes, swamps and the like.

Known submergible pumping systems for petroleum wells typically include a pump coupled to a submergible electric motor. A motor protector may be provided adjacent to the electric motor to protect against temperature and pressure variations in the portion of the wellbore where the submergible unit will be positioned. Inlet apertures surrounding the pump allow production fluids to flow into the pump. The electric motor drives the pump in rotation to pressurize the production fluids and to force them through a conduit to the earth's surface. Pumping units generally of this type are commercially available from Reda of Bartlesville, Okla.

While heretofore known pumping systems are generally sufficient to collect and pump many production fluids from wellbores, they may experience difficulties in handling particularly viscous or heavy fluids. Because the viscosity of such fluids is generally a function of temperature, in certain applications heaters have been employed adjacent to submergible pumping units to preheat the fluids until their viscosity becomes sufficiently low to be pumped from the wellbore. In extreme cases, such heaters may be employed to melt solidified petroleum, paraffin waxes, hydrates and the like which can, once liquefied, be pumped via the submergible pumping system to the earth's surface.

Submergible heating systems of the type mentioned above are commonly attached to existing pumping systems including electric motor and pump sets. The heating system is powered by electrical energy transmitted through independent cables which run adjacent to the pumping system and upward through the wellbore to a power supply located at the earth's surface. Control of the heating unit is accomplished by modulating power input to the heating unit through the power supply cables. Because the heating unit is powered independently of the pumping unit, the heating unit cables are in addition to the power supply and control cables used to provide electrical energy for driving the electric motor.

While such arrangements may, in certain applications, provide adequate heating for viscous wellbore fluids, they are not without drawbacks. For example, depending upon the relative sizes of the wellbore casing and of the electric motor and pump assembly, very little clearance may be available in the wellbore for the additional power cables necessary to supply electrical energy to the heater. Similarly, the provision of multiple power cables for the heating unit and the pumping unit add considerable cost and weight to the pumping system. Furthermore, such arrangements typically require separate power supplies and associated controls for the heating unit and the submergible electric motor. All of these factors contribute to significantly increasing the overall cost of the submergible pumping system and render the equipment more difficult to assemble, install and manage.

There is a need, therefore, for an improved technique for heating viscous fluids in a well which addresses these drawbacks of existing systems. In particular, there is a need for a submergible pumping system which can, in addition to pumping, reduce the viscosity of the viscous fluids adjacent to the pumping unit by heating these viscous fluids and thereby improve the ability of the submergible pumping system to pump and which does not require the addition of heater elements to the submergible pumping system.

SUMMARY OF THE INVENTION

The invention provides a system and method for pumping and heating viscous fluids adjacent to a submergible pumping unit that is designed to respond to these existing needs. The system and method may be used in a variety of applications, but is particularly well suited to heating production fluids, such as crude oil in petroleum wells and the like. The system employs a submergible pumping unit that includes a submergible electric motor drivingly coupled to a submergible pump. The system further includes at least one electric power supply to provide power to operate the submergible pumping unit to pump viscous fluids and to generate heat. The submergible electric motor has a plurality of phases and each phase is transmitted power by a plurality of electrical conductors. Electric power is provided through the electrical conductors to the submergible electric motor by a switchboard. When pumping viscous fluids in a wellbore the submergible pumping system can generate heat in the pumping system itself and in the power cable to heat the viscous fluids. When not pumping viscous fluids the system can generate heat due to current flowing in the power cable conductors and the submergible electric motor by supplying electric power and maintaining the submergible electric motor in a stationary-rotor condition.

According to another aspect of the invention, a system is provided for pumping and heating viscous fluids in a wellbore. The system is comprised of a submergible pumping unit including a multi-phase submergible electric motor drivingly coupled to a submergible pump, a first and a second electrical power supply disposed proximate a surface of the earth to provide power to the submergible pumping unit, a plurality of electrical conductors wherein each phase of the multi-phase submergible electric motor is coupled to a first electrical conductor and a second electrical conductor, and a switchboard coupling the electrical power supplies to the plurality of electrical conductors. In a first switch configuration, the first power supply is coupled through the first and the second electrical conductors of each phase to the multi-phase submergible electric motor and in a second switch configuration the second power supply is coupled through the second electrical conductor to each phase of the multi-phase submergible electric motor.

According to another aspect of the invention, a method is provided for pumping and heating viscous fluids in a wellbore. The method is comprised of the steps of: submerging a submergible pumping unit into the viscous fluid, the submergible pumping unit comprising a submergible pump and a submergible electric motor drivingly coupled to the submergible pump. The method further includes electrically connecting the submergible electric motor to one or more electric power supplies via a plurality of conductors, and supplying electric power to the submergible pumping unit through the plurality of conductors. Viscous fluids are heated due to the heat generated by electric current flowing through the conductors and through the submergible electric motor without operation of the submergible electric motor. The method also includes selectively changing the current flow to operate the submergible electric motor.

BRIEF DESCRIPTION OF THE DRAWINGS

The invention will be hereafter be described with reference to the accompanying drawings, wherein like reference numerals denote like elements, and.

DETAILED DESCRIPTION OF THE PREFERRED EMBODIMENTS

Figure 1:
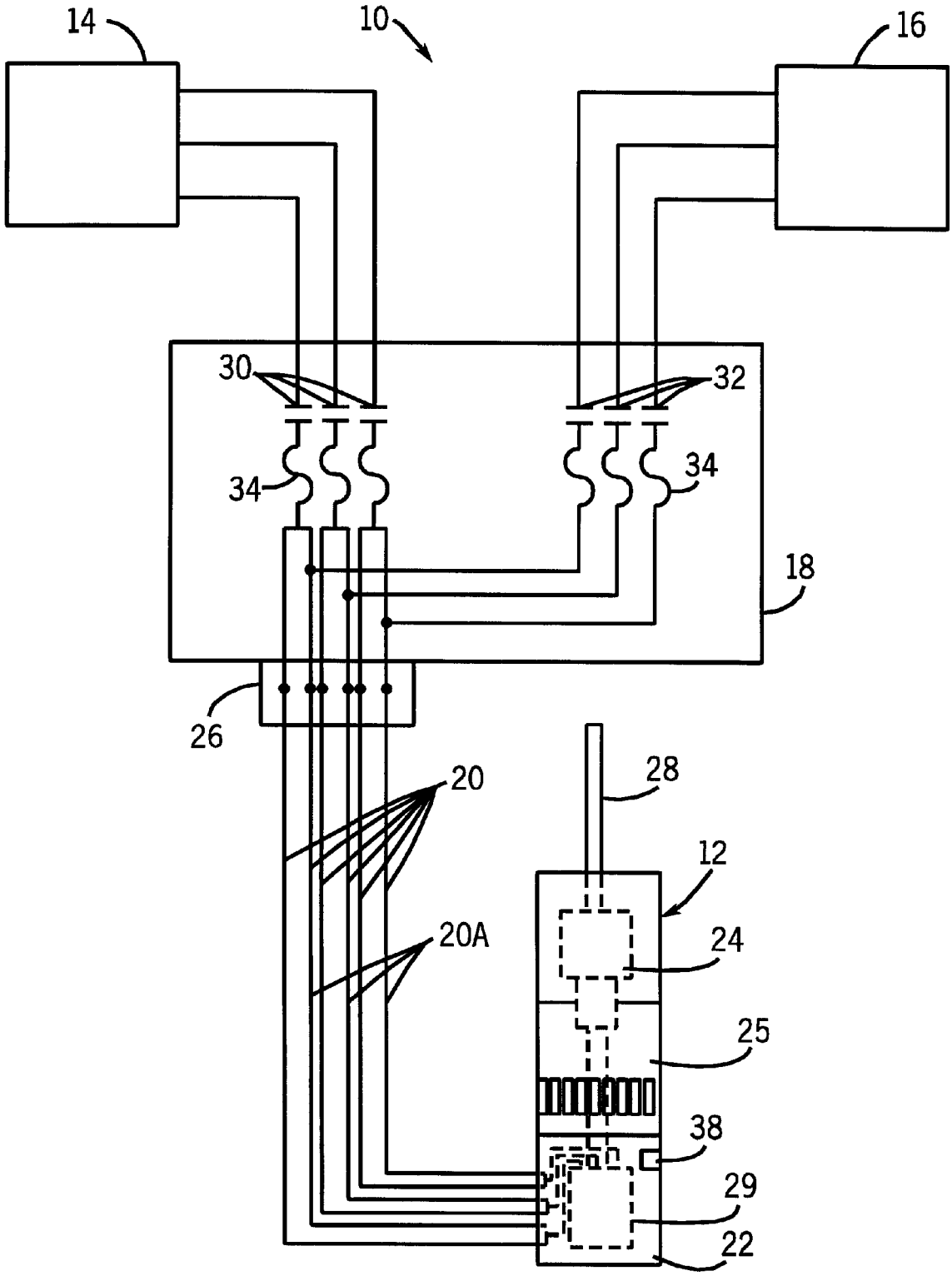
FIG. 1 is a schematic representation of a submergible pumping system for pumping and heating viscous fluids in a wellbore, according to a preferred embodiment of the present invention.

Referring generally to FIG. 1, a schematic representation of a submergible pumping system 10 is illustrated according to a preferred embodiment of the present invention. System 10 may be comprised of a variety of components, however, it typically includes at least a submergible pumping unit 12, a first electrical power supply 14, a second electrical power supply 16, a switchboard 18, and six conductors 20.

The submergible pumping unit 12 typically includes a submergible electric motor 22 drivingly coupled to a submergible pump 24 having a fluid intake 25. Submergible pumping unit 12 is connected to a length of conduit for conveying fluid to the surface 28. Submergible pumping unit 12 also is electrically coupled to an electrical junction box 26, that may be disposed at a surface location. The motor may utilize direct current or alternating current. The motor may be a single phase motor or a polyphase motor. As illustrated, the submergible electric motor 22 is a three-phase motor and the motor windings include stator windings 29 for each of the three power phases. Heat is generated in the submergible electric motor 22 as electrical current flows through the stator windings. The submergible pumping unit 12 is configured to transfer the heat generated in the stator windings to the surrounding viscous fluids.

The electrical power supplied by the first power supply 14 may be alternating current or direct current, single phase or polyphase depending upon the submergible electric motor 22 used. Furthermore, the voltage and frequency can be fixed, such as standard line supplied three-phase alternating current, or a variable speed drive may be used to vary the speed of the submergible electric motor 22 and, thus, the rate of fluid pumping. The particular form of the variable speed drive may vary, depending upon the type of motor employed. However, any suitable variable speed drive may be used, such as pulse width modulated AC drives, silicon controlled rectifier (SCR) or transistor type AC variable speed drives, variable voltage drives, and so forth. Additionally, the electrical power supplied by the second power supply 16 may be alternating current or direct current and need not be in the same form as the first power supply.

Electrical power to pump and heat viscous fluids in the wellbore is supplied from the surface. As illustrated, first electrical power supply 14 and second electrical power supply 16 are used, alternatively, to supply electrical power to the submergible pumping unit 12. The first power supply 14 is used to supply three-phase power to the submergible electric motor 22 to power pump 24 and thereby pump fluids from the wellbore. The second power supply 16 is used to produce current flow through three of the conductors 20, labeled as 20A, and the submergible electric motor 22 while maintaining the submergible electric motor 22 in a stationary rotor condition. Heat is generated in the three conductors 20A and in submergible electric motor 22 via motor components, such as the stator windings 29, stator laminations (not shown), rotor etc., when the second power supply 16 is supplying power. The heat is transferred to viscous fluids adjacent to the three conductors 20A and the submergible pumping unit 12.

The foregoing description is not meant to imply that only heating of viscous fluids occurs when the second power supply is supplying power to the submergible electric motor 22. The term "heating" refers to the process of heating fluids solely from heat generated by electrical current flowing through the components of the system when power is supplied by the second power supply. Heat will also be produced when the first power supply is supplying power to the submergible pumping unit 12 from the current flowing through the six conductors 20 and the operation of the submergible electric motor 22 and submergible pump 24 in pumping fluid.

In the preferred embodiment, electrical power is coupled through the switchboard 18 and conductors 20 to the submergible pumping unit 12. The switchboard 18 contains circuitry that operates to select the source of power (power supply 14 or 16) and the conductors 20 used to couple power to the submergible pumping unit 12. As illustrated, a plurality of contacts 30 are used to control the selection of power supplies. Contacts 30 must be closed before the first power supply 14 can supply power to the submergible pumping unit. Alternatively, a plurality of contacts 32 must be closed before power can be supplied by the second power supply 16. Circuit protectors 34 protect the system from overloading. As illustrated, the switchboard 18 wiring is configured such that when the first electric power supply 14 is selected electric power is coupled through all six conductors 20 to the submergible pumping unit 12. Alternatively, electric power is coupled through three of those conductors, labeled with reference numeral 20A, when the second electrical power supply 16 is selected. Typically, an individual conductor supplies power for each phase of the submergible electric motor 22. A junction box 26 is disposed in the submergible pumping unit 12 and couples the conductors 20 to the submergible electric motor 22.

The heat produced in an electrical device is primarily a function of the devices efficiency and the amount of current flowing through the device. The total amount of current flow in a circuit is determined by the voltage applied to the circuit and the overall circuit impedance. As illustrated, the electrical resistance of the power cable conductors supplied by the second power supply 16 is greater than the electrical resistance of the power cable conductors supplied by the first power supply 14. Two different electrical circuits are formed depending upon which electrical power supply is supplying power to the submergible pumping unit 12. All six conductors 20 are in the circuit when the first electrical power supply 14 is selected as the source of power. Two conductors in each phase are connected electrically in parallel. However, only three conductors 20A are in the circuit when the second power supply 16 is selected, one conductor for each phase. Electrically, the conductors are resistors and have some resistance to current flow. The total resistance of two resistors connected in parallel is always lower than the lowest resistance of the two individual resistors. Therefore, the overall electrical resistance of the conductors is higher when the second power supply is selected as the source of power.

Additionally, the three conductors 20A can be configured to enhance heat generation and subsequent heat transfer to the viscous fluids by using a material with a higher electrical resistance per foot of length. The higher resistance can be accomplished by decreasing the diameter of the conductors used, or by orienting the conductors in the wellbore to enhance the heat transmission to the adjacent wellbore fluids.

Also, system 10 may include one or more temperature sensors 38 to provide a signal representative of either the temperature of the submergible electric motor 22 or the temperature of the viscous fluids adjacent to the submergible pumping unit. Temperature signals from the sensors can be transmitted to the surface through a dedicated signal cable or by utilizing the conductors 20. Additionally, the temperature signals from the temperature sensor 38 can be coupled to protection circuits to reduce or remove power when the submergible electric motor 22 exceeds a predetermined temperature.

Figure 2:
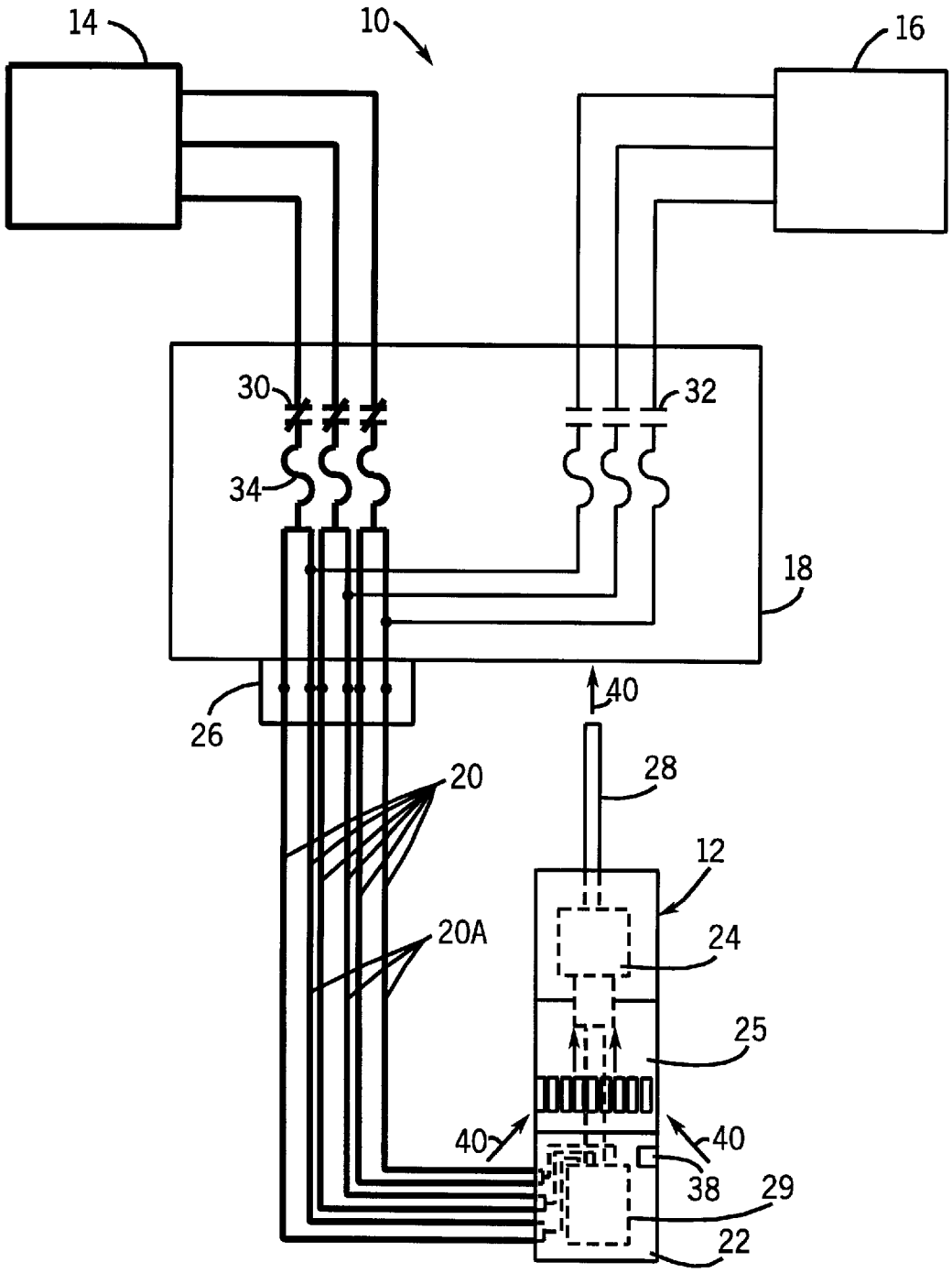
FIG. 2 is a schematic representation of the submergible pumping system illustrated in FIG. 1, in a mode for pumping and heating viscous fluids in a wellbore.

Referring generally to FIG. 2, a schematic representation is provided to illustrate the fluid pumping made of submergible pumping system 10 in which viscous fluids are heated and pumped from a wellbore. The current path for the pumping operation is indicated in bold. When the system is operated to pump fluid from the wellbore, electric current flows from the first electrical power supply 14 to the switchboard 12. The switchboard operates to open contacts 32 before closing contacts 30. This prevents both power supplies from supplying power to the submergible electric motor 22 simultaneously. This also prevents one electrical power supply from supplying power to the other electrical power supply. Current flows through contacts 30 and circuit protection devices 34 to the six conductors 20. The six conductors couple power to the junction box 26 in the submergible pumping unit 12. The junction box 26 couples power to the submergible electric motor 22. The submergible electric motor 22 operates to drive the submergible pump 24. Wellbore fluid 40 is drawn into the submergible pump 24 through pump intake 25 and discharged from the submergible pump through a length of conduit 28, e.g. production tubing or coil tubing.

Figure 3:
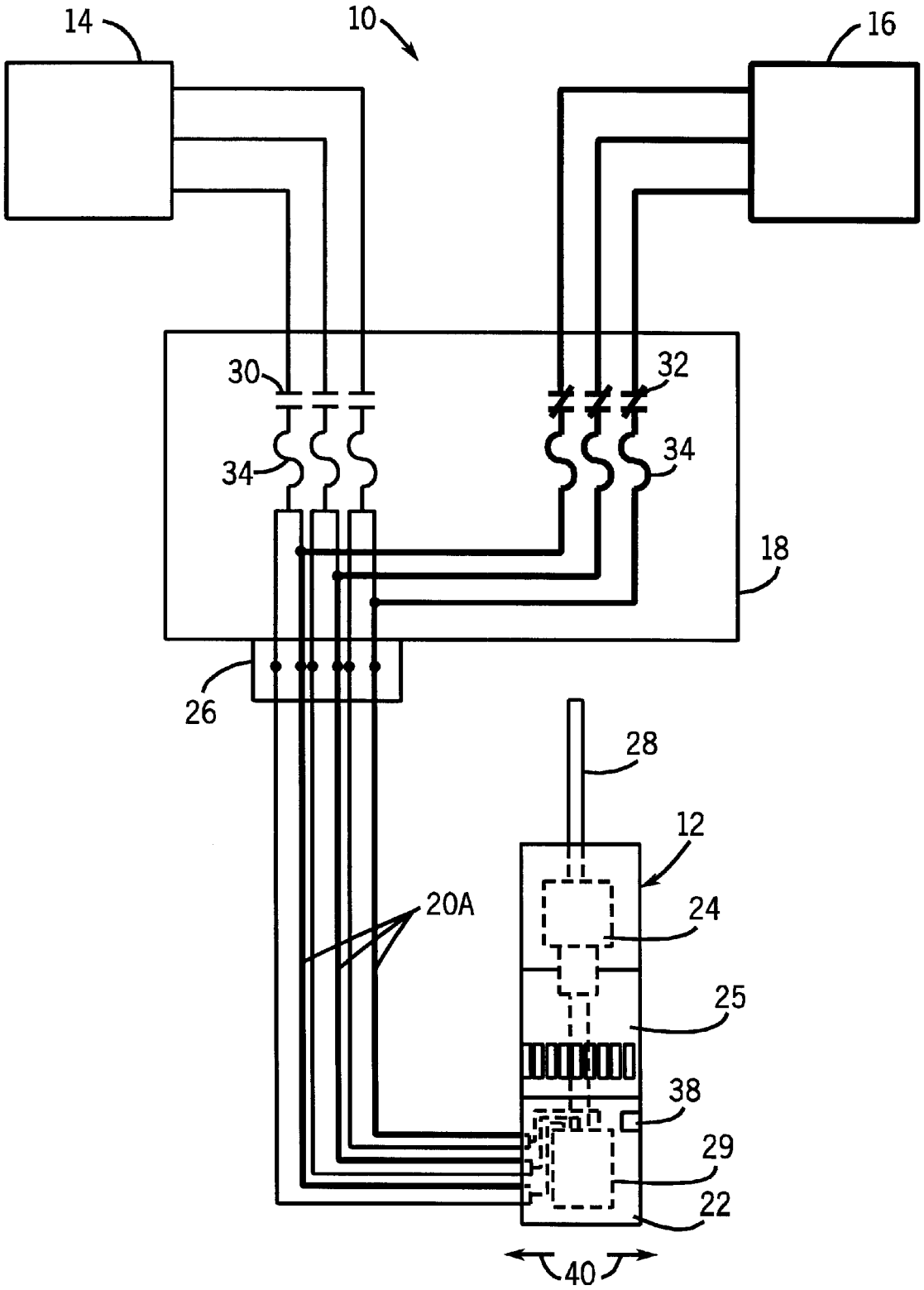
FIG. 3 is a schematic representation of the submergible pumping system illustrated in FIG. 1, in an alternate mode of operation.

Referring generally to FIG. 3, a schematic representation is provided to illustrate heating of wellbore fluid disposed about submergible pumping system 10 while motor 22 is in a stationary rotor mode. The current path for viscous liquid heating operation is indicated in bold. When the system is operated to pump fluid from the wellbore, electric current flows from the second electrical power supply 16 to the switchboard 18. The switchboard 18 operates to open contacts 30 before closing contacts 32. This prevents both power supplies from supplying power to the submergible electric motor 22 simultaneously. This also prevents one electrical power supply from supplying power to the other electrical power supply.

In this mode, current flows through contacts 32 and circuit protection devices 34 to three of the conductors, labeled 20A. The three conductors couple power to the junction box 26 in the submergible pumping unit 12. The junction box 26 couples power to the submergible electric motor 22. Current flows through the submergible electric motor 22 but the power provided maintains the rotor of the submergible electric motor in a stationary rotor condition. Wellbore fluid 40 (see FIGS. 2 and 4) is not pumped by the submergible pump 24 when the submergible electric motor is in a stationary rotor condition. However, heat is produced in the three conductors 20A and in submergible electric motor 22 components, such as the stator windings 29, stator laminations (not shown), etc., due to the current flow therethrough. The heat is transferred from the three conductors 20A and the submergible electric motor 22 components to the adjacent viscous fluids, lowering the viscosity of the viscous fluids. This mode of heating is particularly helpful in lowering the viscosity of the surrounding wellbore fluid prior to initiating pumping of the fluid.

Figure 4:
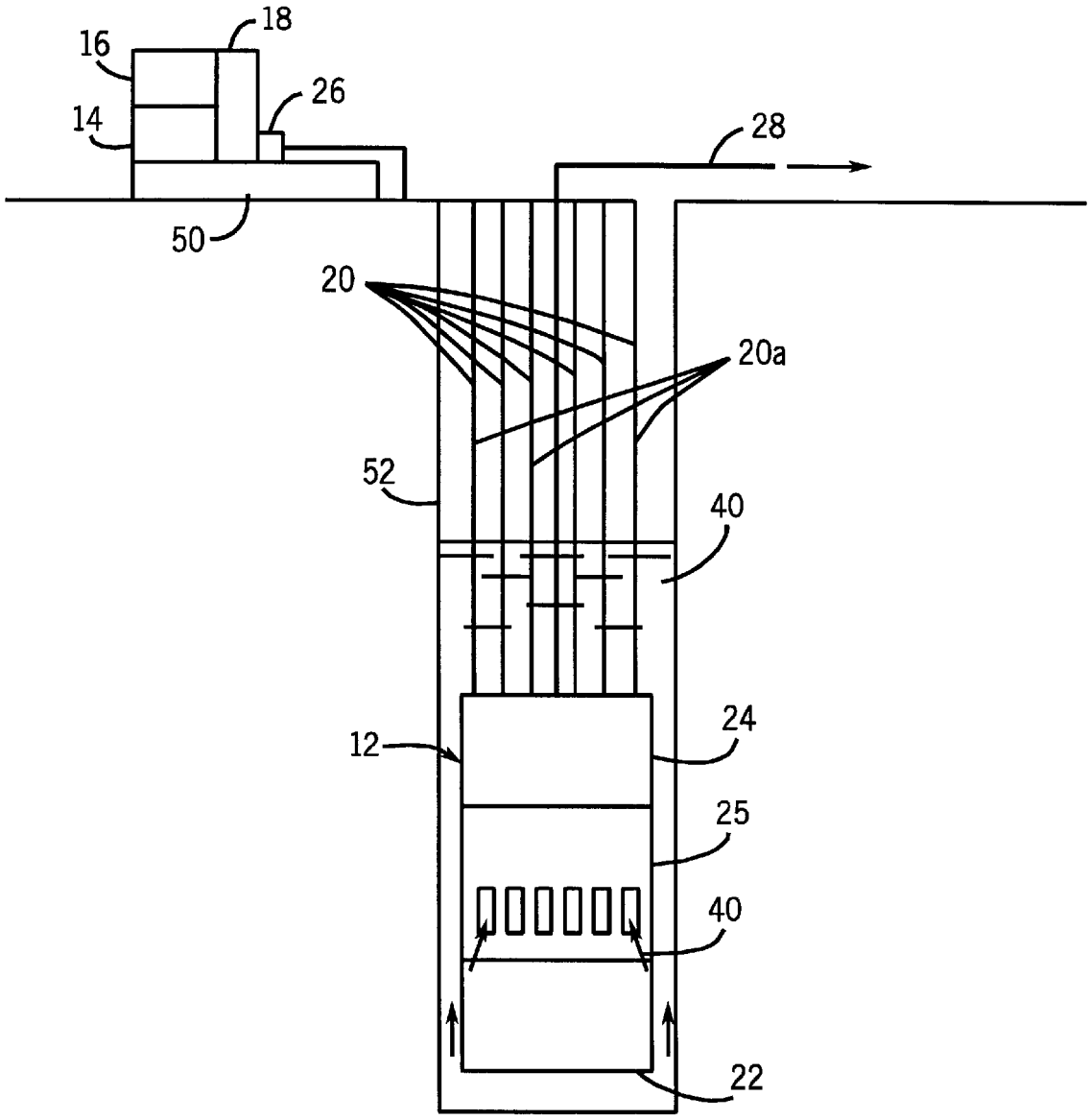
FIG. 4 is a front elevational view of the submergible pumping system of FIG. 1 disposed in a wellbore.

Referring generally to FIG. 4, a front elevational view is shown of the submergible pumping system 10 disposed in a wellbore. The first electrical power supply 14 and the second electrical power supply 16 are placed, along with the switchboard 18, on a skid 50 near a wellbore 52. The two power supplies are electrically connected to the switchboard 18. The six electrical conductors 20 are connected to the switchboard 18 and to the submergible pumping unit 12. The submergible pumping unit 12 is lowered into a wellbore 52 and into viscous wellbore fluid 40. If the fluid in the wellbore 52 has low enough viscosity, the pumping operation may begin immediately. However, it may be desirable to lower the viscosity of the viscous fluid 40 prior to attempting pumping operations. In that case, the heating operation is initiated prior to pumping.

During the pumping operation, power is supplied by the first electrical power supply 14 to the switchboard 18. Current flows from the first electrical power supply 14 through the switchboard 18, the junction box 26, and the six conductors 20 to in the submergible pumping unit 12 (see FIG. 2 and description above). Current flow continues within the submergible pumping unit 12 from the junction box 26 to the submergible electric motor 22. The rotor of the submergible electric motor 22 rotates to drive the submergible pump 24. Fluid is drawn into the submergible pumping unit 12 through pump intake 25. Fluid is discharged from the submergible pumping unit 12 through a length of conduit 28 to the surface.

During the heating operation, power is supplied by the second electrical power supply 16. Current flows from the second electrical power supply 16 through the switchboard 18 and three of the six conductors, e.g. conductors 20A, to the junction box 26 in the submergible pumping unit 12 (see FIG. 3 and description above). Current flow continues within the submergible pumping unit 12 from the junction box 26 to the submergible electric motor 22. Current flows through the stator winding of the submergible electric motor 22 but the power provided maintains the rotor of the submergible electric motor in a stationary rotor condition, e.g. the power is insufficient to rotate the rotor.

Heat generated by the current flow through three of the six conductors 20A and the submergible electric motor 22 components, such as the stator windings 29, stator laminations (not shown), rotor, etc., is transferred to the viscous fluid 40 adjacent to the conductors and submergible pumping unit 12. The transferred heat raises the temperature of the viscous fluid 40 and produces less viscous fluid. The required time for heating will be determined by a number of factors, including the viscosity, the temperature of the viscous fluid 40 in the wellbore, and the amplitude of the current flow.

It will be understood that the foregoing description is of preferred embodiments of this invention, and that the invention is not limited to the specific forms shown. The number of electrical power supplies and conductors used can vary from one electrical power supply and two conductors upward in a variety of combinations. For example, electrical power may be supplied by one electrical power supply capable of alternatively providing two voltages, a first voltage to operate the submergible pumping unit and a second voltage to induce current flow through the conductors and through the submergible electric motor windings to produce heat while maintaining the motor in a stationary-rotor condition. In this case the number of conductors used to transmit power could remain the same during pumping and heating. In a similar vein, electrical power may be provided by one adjustable power supply capable of providing a range of voltages as required for pumping and heating. Additionally, two conductors can be provided to each phase of the motor, one with a low electrical resistance and one with a sufficiently high electrical resistance (or an additional resistive element can be placed in series with the second conductor). During pumping operations the low electrical resistance conductor can be selected to couple power to the motor. During heating operations the high electrical resistance conductor can be selected. If the resistance of the conductor is sized correctly the voltage drop across the conductor could be large enough such that the voltage across the motor maintains the motor in a locked-rotor condition while still providing current flow for heating. These and other modifications may be made in the design and arrangement of the elements without departing from the scope of the invention as expressed in the appended claims.

What is claimed is:

1. A system for pumping and heating viscous fluids in a wellbore, comprising;

a submergible pumping unit, the submergible pumping unit including a submergible electric motor drivingly coupled to a submergible pump;

a plurality of conductors for transmitting electrical power to the submergible electric motor, the submergible electric motor having a plurality of phases wherein each phase is supplied power by a plurality of conductors;

at least one electrical power supply to provide power to operate the submergible pumping unit to pump a fluid and, alternatively, to provide power to generate heat in the conductors and in the submergible electric motor due to current flow therethrough while maintaining the submergible electric motor in a stationary-rotor condition; and a switchboard for coupling the at least one electrical power supply to the submergible electric motor through the conductors, wherein the at least one electrical power supply comprises dual electric power supplies including a first power supply to supply electrical power to operate the submergible pumping unit and a second power supply to supply electrical power to generate heat from current flowing through the conductors and submergible electric motor when not pumping viscous fluids.

2. The system as recited in claim 1, wherein the submergible electric motor is a polyphase alternating current electric motor having stator windings for each of a plurality of power phases.

3. The system as recited in claim 2, wherein the submergible electric motor is maintained in a stationary-rotor condition when receiving power from the second power supply.

4. The system as recited in claim 2, wherein the first power supply is a variable speed drive.

5. The system as recited in claim 2, wherein the second power supply provides direct current (DC).

6. The system as recited in claim 1, wherein the switchboard includes a plurality of circuit interrupters to selectively complete and interrupt current carrying paths from the first and the second power supplies to the submergible electric motor.

7. The system as recited in claim 6, wherein the number of conductors electrically coupled between the first and the second electric power supplies and each phase of the submergible electric motor may be selected by the plurality of circuit interrupters.

8. The system as recited in claim 7, wherein the plurality of conductors electrically coupled between the first and the second electric power supplies and each phase of the submergible electric motor includes conductors of a plurality of electrical resistances.

9. The system as recited in claim 1, further comprising a motor temperature sensor to monitor the submergible electric motor temperature and to output a signal indicative of motor temperature.

10. The system as recited in claim 9, wherein the signal is transmitted to a surface of the earth via at least one of the conductors.

11. The system as recited in claim 10 further comprising a power reducer to reduce power to the submergible electric motor when the submergible electric motor exceeds a predetermined temperature.

12. The system as recited in claim 1, further comprising a temperature sensing unit coupled to the pumping unit, the temperature sensing unit being configured to output signals representative of the temperature of the viscous fluids.

13. The system as recited in claim 12, wherein the temperature signals are transmitted to a surface of the earth via at least one of the conductors.

14. The system as recited in claim 1, wherein electrical power is provided by a dual voltage power supply capable of alternatively providing two voltages, a first voltage to operate the submergible pumping unit and a second voltage to induce current flow through the conductors and through submergible electric motor windings.

15. The system as recited in claim 1, wherein electrical power is provided by an adjustable power supply capable of providing a range of voltages.

16. A system for pumping and heating viscous fluids in a wellbore, comprising;

a submergible pumping unit including a multi-phase submergible electric motor drivingly coupled to a submergible pump;

a first and a second electrical power supply disposed proximate a surface of the earth to provide power to the submergible pumping unit;

a plurality of electrical conductors wherein each phase of the multi-phase submergible electric motor is coupled to a first electrical conductor and a second electrical conductor; and a switchboard coupling the electrical power supplies to the plurality of electrical conductors, wherein in a first switch configuration, the first power supply is coupled through the first and the second electrical conductors of each phase to the multi-phase submergible electric motor and in a second switch configuration the second power supply is coupled through the second electrical conductor to each phase of the multi-phase submergible electric motor.

17. The system as recited in claim 16, wherein the first electrical power supply supplies sufficient power to operate the multi-phase submergible electric motor and to generate heat from current flowing through the plurality of conductors and through the multi-phase submergible electric motor.

18. The system as recited in claim 16, wherein the second electrical power supply establishes a current through the plurality of conductors and the multi-phase submergible electric motor without moving the multi-phase submergible electric motor from a stationary-rotor condition.

19. The system as recited in claim 16, wherein the second electrical conductors for each phase of the submergible electric motor are of a higher electrical resistance than the first electrical conductors for each phase of the submergible electric motor.

20. The system as recited in claim 16, wherein the switchboard interrupts power to the submergible electric motor before alternating switch configurations.

21. A method for pumping and heating viscous fluids in a wellbore, the method comprising the steps of:

submerging a submergible pumping unit into the viscous fluid, the submergible pumping unit comprising a submergible pump and a submergible electric motor drivingly coupled to the submergible pump;

electrically connecting the submergible electric motor to one or more electric power supplies via a plurality of conductors;

supplying electric power to the submergible pumping unit through the plurality of conductors;

heating viscous fluids from the heat generated by electric current flowing through the conductors and through the submergible electric motor without operating the submergible electric motor; and selectively changing the current flow to operate the submergible electric motor, wherein the current flowing through the plurality of conductors and submergible electric motor can be changed by selectively changing the number of conductors comprising the plurality of conductors, wherein the plurality of conductors includes conductors of a plurality of electrical resistances and further wherein the total electrical resistance of the plurality of conductors can be changed by selectively changing the conductors comprising the plurality of conductors.

* * * * *